US005390800A

United States Patent [19]

Tucker

[11] Patent Number: 5,390,800

[45] Date of Patent: Feb. 21, 1995

[54] DISPLAY OF OBJECTS

[76] Inventor: Nancy Tucker, Elm St., Norwich, Vt. 05055

[21] Appl. No.: 135,685

[22] Filed: Oct. 13, 1993

[51] Int. Cl.[6] ..... A47F 7/00

[52] U.S. Cl. ..... 211/13; 206/495; 206/6.1

[58] Field of Search ..... 211/13; 206/495, 6.1, 206/566; 40/152.2

[56] References Cited

U.S. PATENT DOCUMENTS

| | | | |
|---|---|---|---|
| 2,902,287 | 9/1959 | Cook | 40/152.2 |
| 4,606,458 | 8/1986 | LaBate | 206/495 X |
| 4,687,103 | 8/1987 | Corbett | 206/495 X |
| 4,767,011 | 8/1988 | Butler | 206/566 X |
| 4,905,821 | 3/1990 | Corbett | 206/6.1 X |
| 4,922,384 | 5/1990 | Torrence | 40/152.2 X |
| 5,050,745 | 9/1991 | Sanders | 206/495 X |
| 5,253,750 | 10/1993 | Keffer | 206/6.1 |

*Primary Examiner*—Robert W. Gibson, Jr.
*Attorney, Agent, or Firm*—George E. Kersey

[57] ABSTRACT

Method and apparatus for the display of objects by at least one screen disposed between inner and outer frames for suspending objects; a plurality of screens with different meshes can be employed in order to adapt the display to the suspension of different classes of objects; and the inner frame can have a beveled surface facing the screen to facilitate the placement of objects on the screen.

17 Claims, 3 Drawing Sheets

FIG. 1
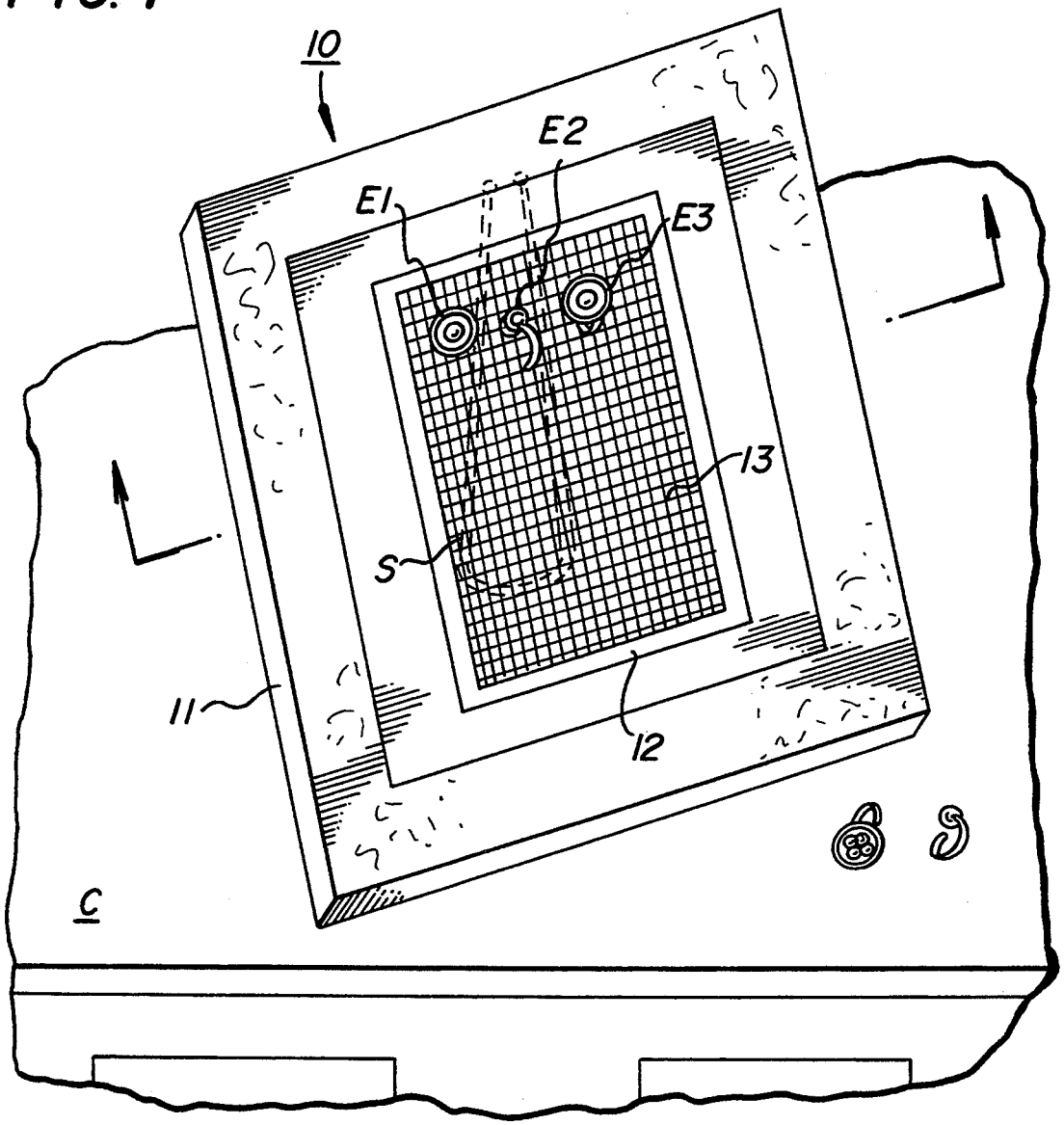
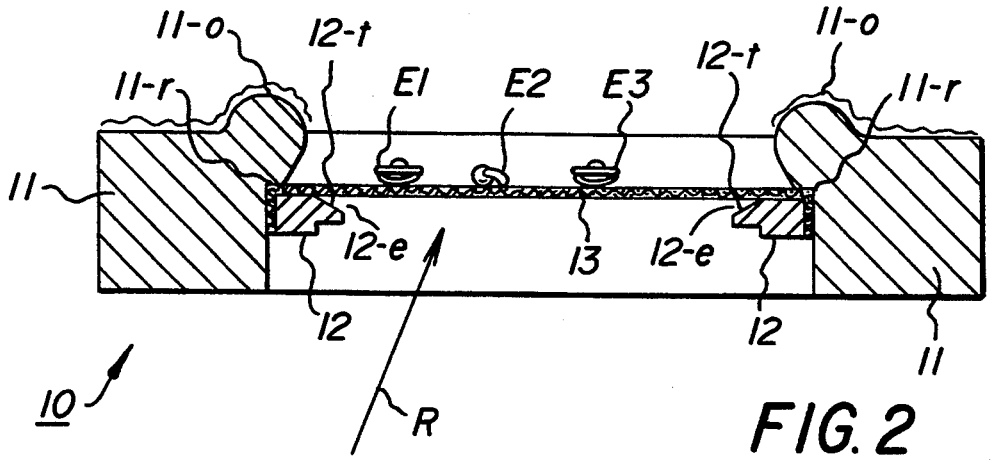
FIG. 2

FIG. 3
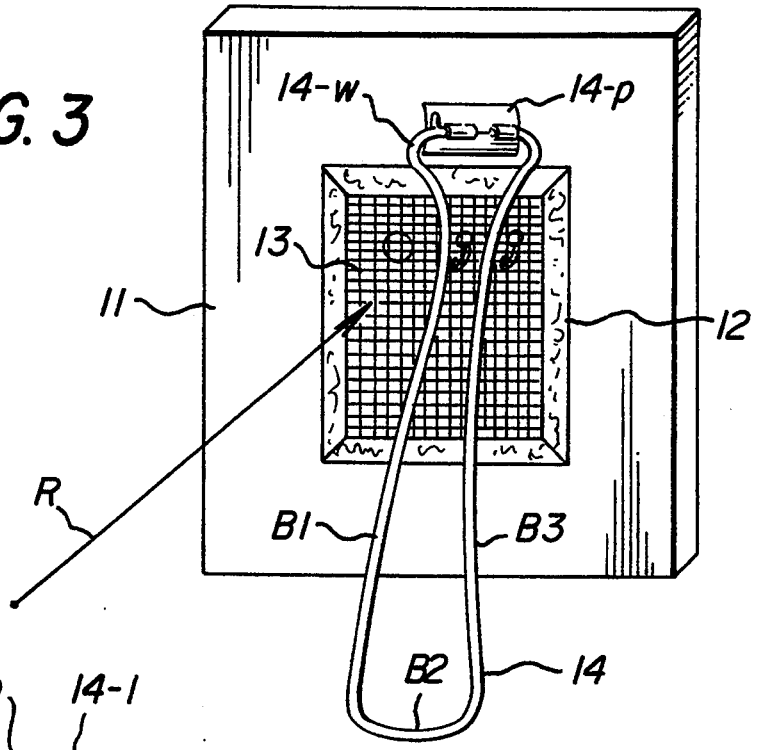
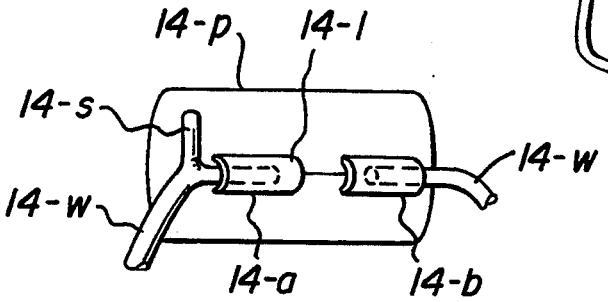
FIG. 3A
FIG. 4A
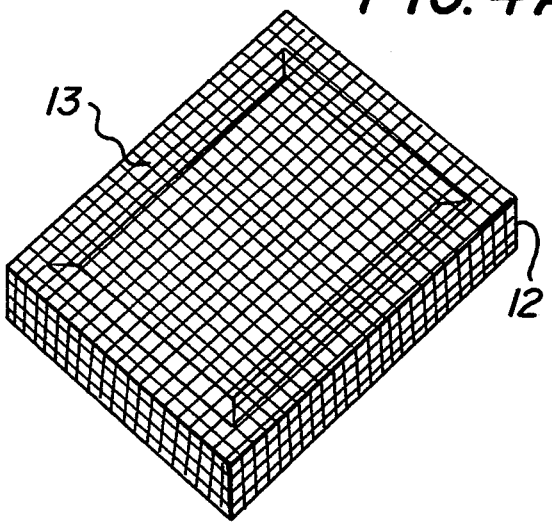
FIG. 4B
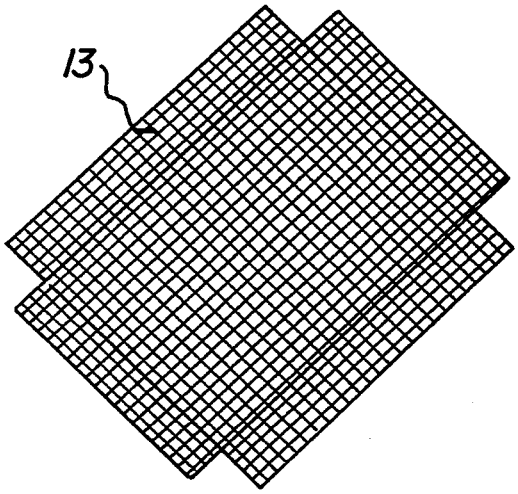

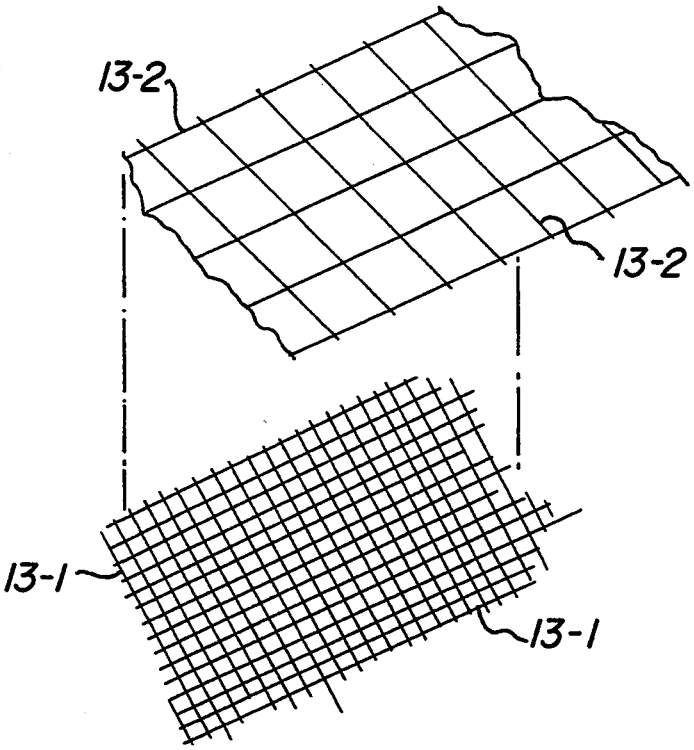
FIG. 4C
FIG. 5A
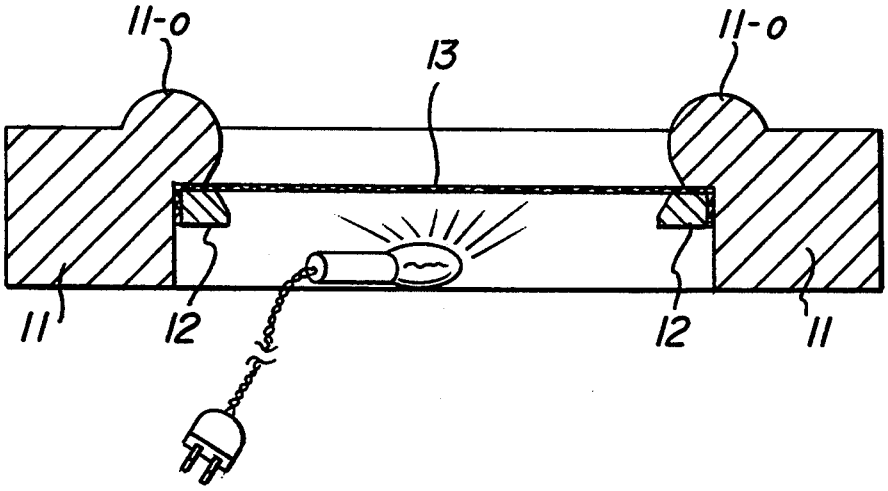
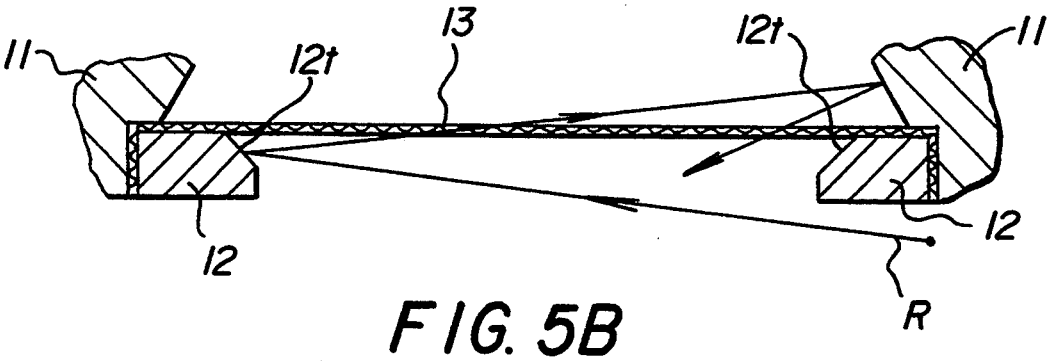
FIG. 5B

DISPLAY OF OBJECTS

This invention relates to the display of objects, and more particularly to the display of ornamental objects, such as earrings, and utilitarian objects, such as fishing tackle.

Ornaments, such as earrings, are frequently stored in a container where they are not readily visible to a user. Indeed the ornaments tend to become entangled while in such storage, with the result that they can be damaged, and even broken, when removed for use.

Similarly, many utilitarian objects, such as fishing tackle, are frequently stored in a container where they are not readily visible to a user. Again the objects tend to become entangled while in such storage, with the result that they can be damaged, and even broken, when removed for use.

Accordingly, it is a principal object of the invention to facilitate the storage of objects such as ornamental earrings and utilitarian fishing tackle.

Another object of the invention is to provide a display that provides ready access to objects, such as ornamental earrings and fishing tackle. A related object is to avoid the entanglements that occur when objects are place in conventional drawers and boxes.

A further object of the invention is to provide for the storage of objects, particularly ornamental earrings and fishing tackle, in a fashion that places the objects in a decorative display.

Yet another object is to expedite the selection process by which a user selects objects, such as ornamental earrings items of fishing tackle, that are most suitable for a particular occasion. A related object is aid the selection process after dark when the conventional storage box does not allow ease of selection in the relatively dim surrounding lighting.

SUMMARY OF THE INVENTION

In accomplishing the foregoing and related objects, the invention provides for the display of objects by an inner frame disposed within an outer frame, with an arrangement between the inner and outer frames for suspending the objects.

In accordance with one aspect of the invention there is the further provision for positioning the frames for non-horizontal display of the objects, for example, upon a horizontal surface. Alternatively, the frames can be supported upon a vertical surface.

In accordance with another aspect of the invention the positioning arrangement is a screen formed by orthogonally disposed and separated filaments. In addition the outer frame can be ornamented to enhance the ornamental presentation afforded by objects positioned on the screen.

In accordance with a further aspect of the invention, the inner frame can have a beveled surface facing the screen to facilitate the placement of objects on the screen. The objects can be ornaments, such as earrings, or items, such as fishing tackle, which are secured to the screen.

Illumination can be positioned behind the combination of the inner and outer frames for the back lighting of objects on the screen.

In a method of displaying objects in accordance with the invention the steps include (a) positioning an outer frame containing an inner frame disposed with an arrangement between the inner and outer frames for suspending objects and (b) selectively positioning objects on the suspension arrangement so that the suspended objects are readily accessible and the frames and suspended objects provided a suitable display.

A further step of the method for displaying objects in accordance with the invention can be the back-lighting the suspended objects.

Another step can include altering the arrangement of the suspended objects to change the aesthetic effect created by the display.

An additional step can include placing the apparatus in an upright position and reflecting light from the inner frame to enhance the illumination of the objects and provide a further decorative effect in the case of ornaments.

In a method of the invention to provide for the display of objects, the steps can include (a) providing an outer frame; (b) positioning an inner frame within the outer frame; and (c) suspending objects between the inner and outer frames. A reflective surface can be included on the inner frame, and a screen can be positioned on the inner frame for the suspension of objects. The screen is secured over and around said inner frame, and there can be line contact of the screen with the face of the inner frame.

DESCRIPTION OF THE DRAWINGS

Other aspects of the invention will become apparent after considering several illustrative embodiments, taken in conjunction with the drawings, in which:

FIG. 1 is a perspective view of a storage frame in accordance with the invention;

FIG. 2 is a cross-sectional view of the storage frame of FIG. 1 taken along the lines 2—2;

FIG. 3 is a back view of the storage frame of FIG. 1;

FIG. 3A is a detailed fragment of FIG. 3;

FIG. 4A is a perspective view of a screen-covered inner frame of the storage frame of FIG. 1;

FIG. 4B is a perspective view of the screen of FIG. 4A before being secured to the inner frame;

FIG. 4C is an exploded view of two screens for use in suspending objects in accordance with the invention;

FIG. 5A is a sectional perspective view of a back-lighted storage frame in accordance with the invention; and FIG. 5B is a partial sectional view illustrating reflective lighting in accordance with the invention.

DETAILED DESCRIPTION

With reference to the drawings, the storage frame 10 of FIG. 1, which can be used for ornamental items such as earrings, or utilitarian objects such as fishing tackle, is shown positioned on a relatively horizontal surface, such as a chest C, by a hinged support S. The overall frame 10 is formed by an outer frame 11, into which is placed an inner frame 12. Between the frames 11 and 12 is a member 13 by which objects, such as the illustrative earrings E1 though E3 can be suspended. In the case of earrings for pierced ears, the suspension is by a post or wire that extends from the rear of the earring. In the case of "clip-on" earrings, the desired suspension is achieved by using a screen 13 with a wide mesh, i.e. open space between the wires of a screen. Where it is desired to have a narrow mesh for pierced-ear earrings, and a wider mesh for clip-ons, two screens are used. There is an inner, narrow mesh screen 13-1 and an outer wider mesh screen 13-2, as illustrated in FIG. 4C.

As shown in FIG. 2, the outer frame 11 is suitably decorated, having, for example, an ornamented ridge 11-*o*. The outer frame 11 also is undercut below a central rim 11-*r*, against which is positioned the inner frame 12. Positioned between the inner and outer frames 11 and 13 is the screen 13. The edge 12-*e* of the inner frame 12 is tapered to permit the screen 13 to yield slightly when ornaments are being suspended by the frame. In addition the taper 12-*t* can be silvered to permit the reflection of rearwardly directed light to a corresponding silvered taper 11-*t* of the outer frame 11 as shown in FIG. 5B.

It is to noted that the central opening of the inner frame 12 permits back illumination by the illustrative ray R of light shown in FIGS. 2 and 3.

In the back view of FIG. 3 and FIG. 3A, details are shown of the hinged support 14, which is fabricated from a single length of wire 14-*w* with bends B1, B2 and B3. One end 14-1 of the wire 14-*w* is split to form a stop 14-*s* that limits the rotation of the wire 14-*w* when the frame being set in a support position. The remainder of the end 14-1 is inserted into a sleeve 14-*a* of the hinge plate 14-*p*. The other end 14-2 of the wire 14-*w* is simply inserted into the other sleeve 14-*b*. As a result, the wire is easily detached from the frame when that is desired. When the wire is detached, the sleeves 14-*a* and 14-*b* can be used for a vertical mounting of the frame 10, for example, on a wall.

In FIG. 4A, the inner frame 12 is shown covered by the screen 13, which extends over the four sides 12-1 through 12-4 of the frame. An illustrative screen 14' before attachment to the inner frame, is shown in FIG. 4B with respective sides 13-*a* through 13-*d*.

It will be understood that the foregoing detailed description is illustrative only and that other modifications and adaptation will be readily apparent to those of ordinary skill in the art.

What is claimed:

1. Apparatus for the display of objects, comprising an outer frame;

an inner frame disposed within said outer frame;

means between the inner and outer frames for suspending the objects; wherein said inner frame has a beveled surface facing the suspending means;

thereby to facilitate the placement of said objects on said suspending means.

2. Apparatus as defined in claim 1 further including means for positioning said frames for non-horizontal display of said objects

3. Apparatus as defined in claim 2 wherein the positioning means comprises means for supporting said frame upon a horizontal surface.

4. Apparatus as defined in claim 2 wherein the positioning means comprises means for supporting said frame upon a vertical surface.

5. Apparatus as defined in claim 1 wherein the suspending means comprises a screen formed by orthogonally disposed and separated filaments providing an open mesh.

6. Apparatus as defined in claim 1 wherein said outer frame is ornamented;

thereby to enhance the ornamental presentation afforded by said apparatus with objects positioned thereon.

7. Apparatus as defined in claim 5 wherein said objects are earrings which are secured to said screen.

8. Apparatus as defined in claim 7 further including means positioned behind the combination of said inner and outer frames for the back lighting of said objects on said screen.

9. The method of providing for the display of objects, comprising the steps of:

(a) providing an outer frame;

(b) positioning an inner frame within said outer frame; and (c) positioning a first screen on said inner frame for the suspension of ornaments thereon; and (d) positioning a second screen with a different mesh than that of the first screen in order to adapt the display to the suspension of at least two different classes of objects.

10. The method of displaying objects in accordance with claim 9 further including the step of back-lighting said suspended objects.

11. The method of displaying objects in accordance with claim 9 further including the step of altering the arrangement of said suspended objects;

thereby to change the aesthetic effect created by the display of said objects.

12. The method of displaying objects in accordance with claim 9 further including the step of placing said apparatus in an upright position.

13. The method of displaying objects in accordance with claim 11 further including the step of reflecting light from said inner frame to enhance the decorative illumination of said objects.

14. The method of providing for the display of objects in accordance with claim 9 further including the step of providing a reflective surface on said inner frame.

15. The method of providing for the display of objects in accordance with claim 9 wherein said screen is secured over and around said inner frame.

16. The method of providing apparatus for the display of objects in accordance with claim 2 further including the step of providing line contact of said screen with the face of said inner frame.

17. Apparatus for the display of objects, comprising:

(a) an outer frame;

(b) an inner frame positioned within said outer frame; and (c) means for suspending objects between the inner and outer frames comprising a first screen on said inner frame for the suspension of ornaments thereon and a second screen with a different mesh than that of said first screen in order to adapt the display to the suspension of at least two different classes of objects.

* * * * *